US005782389A

United States Patent [19]

Maharg

[11] Patent Number: 5,782,389

[45] Date of Patent: Jul. 21, 1998

[54] LAMINAR CONSTRUCTION VARIABLE CLOTHING FORM

[75] Inventor: James C. Maharg, Ridgefield, Conn.

[73] Assignee: Alu Inc., New York, N.Y.

[21] Appl. No.: 863,869

[22] Filed: May 27, 1997

[51] Int. Cl.[6] ..... D06C 15/00; A41H 5/00

[52] U.S. Cl. ..... 223/66; 223/68

[58] Field of Search ..... 223/66, 68, 120; 434/396; D20/31

[56] References Cited

U.S. PATENT DOCUMENTS

| | | | |
|---|---|---|---|
| D. 316,876 | 5/1991 | Heseltine | D20/31 |
| 456,151 | 7/1891 | Lebel | 223/66 |
| 666,809 | 1/1901 | Kessels | 223/66 |
| 1,012,563 | 12/1911 | Landerberger | 223/68 |
| 1,318,759 | 10/1919 | Motchkin | 223/68 |
| 1,332,146 | 2/1920 | Riordav et al. | 223/68 |
| 2,646,907 | 7/1953 | Clawsey et al. | 223/66 |
| 2,998,903 | 9/1961 | Day | 223/66 |
| 3,279,736 | 10/1966 | Vogt, III | 248/346 |
| 5,248,047 | 9/1993 | Rardhawa | 223/66 |
| 5,265,779 | 11/1993 | Jiaug | 223/66 |

FOREIGN PATENT DOCUMENTS 1037746 5/1951 France .

*Primary Examiner*—Bibhu Mohanty
*Attorney, Agent, or Firm*—Barry G. Magidoff; Reid & Priest LLP

[57] ABSTRACT

A clothing form or mannequin comprising a laminar construction spine including left and right outer spine sections and a central spine section, which are of laminar form and in profile are generally similar to the side profile of a human spine. A plurality of spaced parallel slots extend inwardly from the forward-facing edges of the spine sections, which slots are identically located in each of the spine sections so as to be in registration when the spine sections are positioned side-by-side so as to define a plurality of sets of aligned slots. A flat modular lamina is positioned in each slot at a right angle to the spine. The laminae are configured to resemble cross-sections of a human torso at different positions along the length of a human spine, each of the laminae corresponding to a specific one of the sets of slots in the spine sections, so that the laminae as positioned in the spine give the appearance of a stylized human torso. The rearward-facing edges of the laminae have a generally rectangular notch formed therein, and the notches are dimensioned to mate with the portion of the spine sections to the rear of their corresponding sets of slots. A superficial skin formed of a tube of an elastic material can be stretched over the laminae, to give the clothing form a more realistic appearance.

23 Claims, 11 Drawing Sheets

FIG. 8A
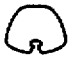
FIG. 8B
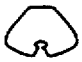
FIG. 8C
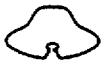
FIG. 8D
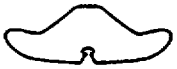
FIG. 8E
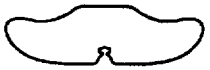
FIG. 8F
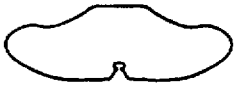
FIG. 8G
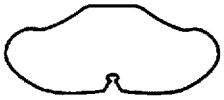
FIG. 8H
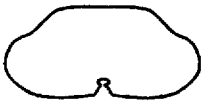
FIG. 8I
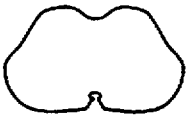
FIG. 8J
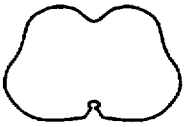
FIG. 8K
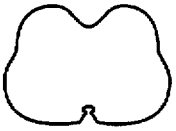
FIG. 8L
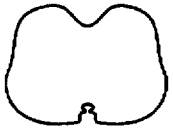
FIG. 8M
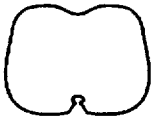
FIG. 8N
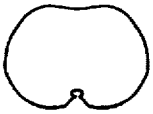
FIG. 8O
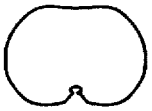
FIG. 8P
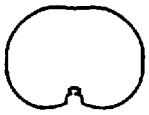
FIG. 8Q
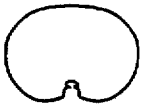
FIG. 8R
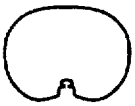
FIG. 8S
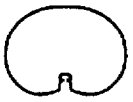
FIG. 8T
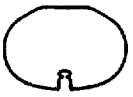
FIG. 8U
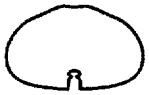
FIG. 8V
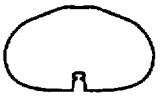
FIG. 8W
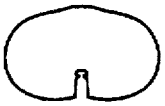
FIG. 8X
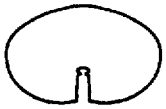
FIG. 8Y
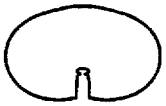
FIG. 8Z
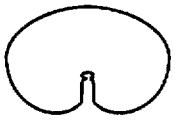
FIG. 8AA
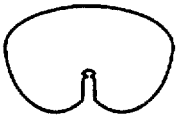
FIG. 8BB
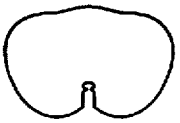
FIG. 8CC
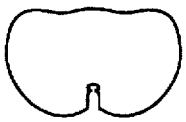
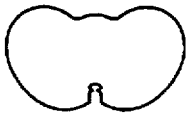
FIG. 8DD
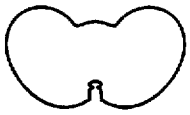
FIG. 8EE
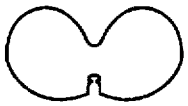
FIG. 8FF
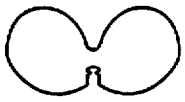
FIG. 8GG

LAMINAR CONSTRUCTION VARIABLE CLOTHING FORM

BACKGROUND OF THE INVENTION

1. Field of the Invention

The present invention relates to a clothing form or mannequin. More specifically, the invention relates to a clothing form or mannequin given a variable construction through the provision of interchangeable laminae.

2. Related Art

Clothing and dress forms and mannequins of adjustable size and shape are well known in the art. One type of mannequin disclosed in French patent No. 1,037,746 comprises a number of interchangeable horizontal elements which are arranged on a central pole to present the form of a human trunk. These elements rest one on top of the other and have interlocking pegs and apertures. Due to this construction, individual elements cannot be removed singly for replacement to change the shape of the mannequin.

U.S. Pat. No. 2,646,907 to Clawsey et al. and U.S. Pat. No. 5,265,779 to Jiang disclose forms in which the parts are attached to a central support or standard and can be moved inwardly and outwardly relative to the central support or standard to change the size of the form. The movable parts in the form disclosed in the Clawsey et al. patent do not appear to be removable, so that the size and shape of the form is limited by to a range within the extreme positions of the different parts. The parts in the form disclosed in the Jiang patent are both removable and adjustable, but the form as a whole is configured solely to perform a utilitarian function, and has little if any aesthetic appeal.

U.S. Pat. Nos. 456,151 and 2,998,903 to Lebel and Day, respectively, are similar in principal to the Clawsey et al. patent, with elliptical or circular members fixed to a central support and movable inwardly and outwardly to accommodate clothing of different sizes, but having a limited range of adjustability.

Finally, U.S. Pat. No. 666,809 to Kessels discloses a type of dress stand in which two bars are provided having in side profile the outline of the front and back of a human torso, and to which bars are hinged curved wires forming ribs of such dimensions and curves that when expended from the sides of the bars at right angles, a torso shape is achieved. This hinged construction has the advantage of being foldable for easy storage, but has the disadvantage of having a fixed size in the extended state.

It is the solution to these and other problems to which the present invention is directed.

SUMMARY OF THE INVENTION

It is therefore an object of the present invention to provide a clothing form or mannequin having a variable construction so as to achieve different sizes and shapes, for example to accommodate clothing of different sizes and for different genders.

It is still another object of the present invention to provide a clothing form or mannequin having a construction which can be varied easily, without disassembly of the entire structure.

These and other objects of the present invention are achieved by provision of a clothing form or mannequin comprising a laminar construction spine including left and right outer spine sections and a central spine section, which are of laminar form and have opposed forward and rearward-facing edges. The spine sections in profile are generally similar to the side profile of a human spine, and have formed therein a plurality of spaced parallel slots extending inwardly from the forward-facing edges, which slots are identically located in each of the spine sections so as to be in registration when the spine sections are positioned side-by-side so as to define a plurality of sets of aligned slots.

A plurality of parallel, flat modular laminae are positioned at right angles to the spine and removably interlock with the spine to give the appearance of a stylized human torso. The laminae are configured to resemble cross-sections of a human torso at different positions along the length of a human spine, each of the laminae corresponding to a specific one of the sets of slots in the spine sections, and each of the lamina having a rearward-facing edge dimensioned for insertion into the corresponding specific sets of slots.

Because the sets of slots are spaced, the laminae are spaced apart from one another.

Each of the rearward-facing edges has a generally rectangular notch formed therein, and the notches are dimensioned to mate with the portion of the spine sections to the rear of their corresponding sets of slots.

Further, the left and right outer spine sections have aligned holes extending therethrough rearwardly of the slots, and the notches have opposed sides having opposed tabs extending therefrom positioned and dimensioned to interlock with the holes.

The left, right, and central spine sections have extending therethrough a plurality of holes spaced along the lengths of the spine sections, inset from the rearward-facing edges. The holes are identically located in each of the spine sections so as to be in registration when the spine sections are positioned side-by-side. A fastener is inserted through each of the holes, to hold the spine sections together.

In one aspect of the invention, a superficial skin formed of a tube of an elastic material can be stretched over the laminae, to give the clothing form a more realistic appearance.

In another aspect of the invention, a mounting bracket can be fastened to the spine for mounting the clothing form to a support. The mounting bracket has a forward end having a vertical mortise formed therein, and the central spine section is provided at the upper end at the rearward-facing edge with a projection which functions as a tenon for mating with the mortise, the mortise being complementary in shape to the projection. The mounting bracket also has a rearward end and upper and lower sides, and the mounting bracket has a side profile in the form of a trapezoid with the edges of the rearward end and the upper and lower sides being at right angles to each other, and the edges of the forward end forming an acute angle with the upper side and an obtuse angle with the lower side. The mortise is complementary in shape to the projection and the upper ends of the rearward-facing edges of the spine sections are complementary in shape to the forward end of the mounting bracket, so that the projection locks in place vertically in the mortise and the mounting bracket as a whole forms an integrated structure with the spine.

BRIEF DESCRIPTION OF THE DRAWINGS

The invention is better understood by reading the following Detailed Description of the Preferred Embodiments with reference to the accompanying drawing figures, in which like reference numerals refer to like elements throughout, and in which:

FIGS. 8A–8GG are top plan views of a complete set of laminae for the clothing form of FIG. 1.

DETAILED DESCRIPTION OF THE PREFERRED EMBODIMENTS

Figure 1:
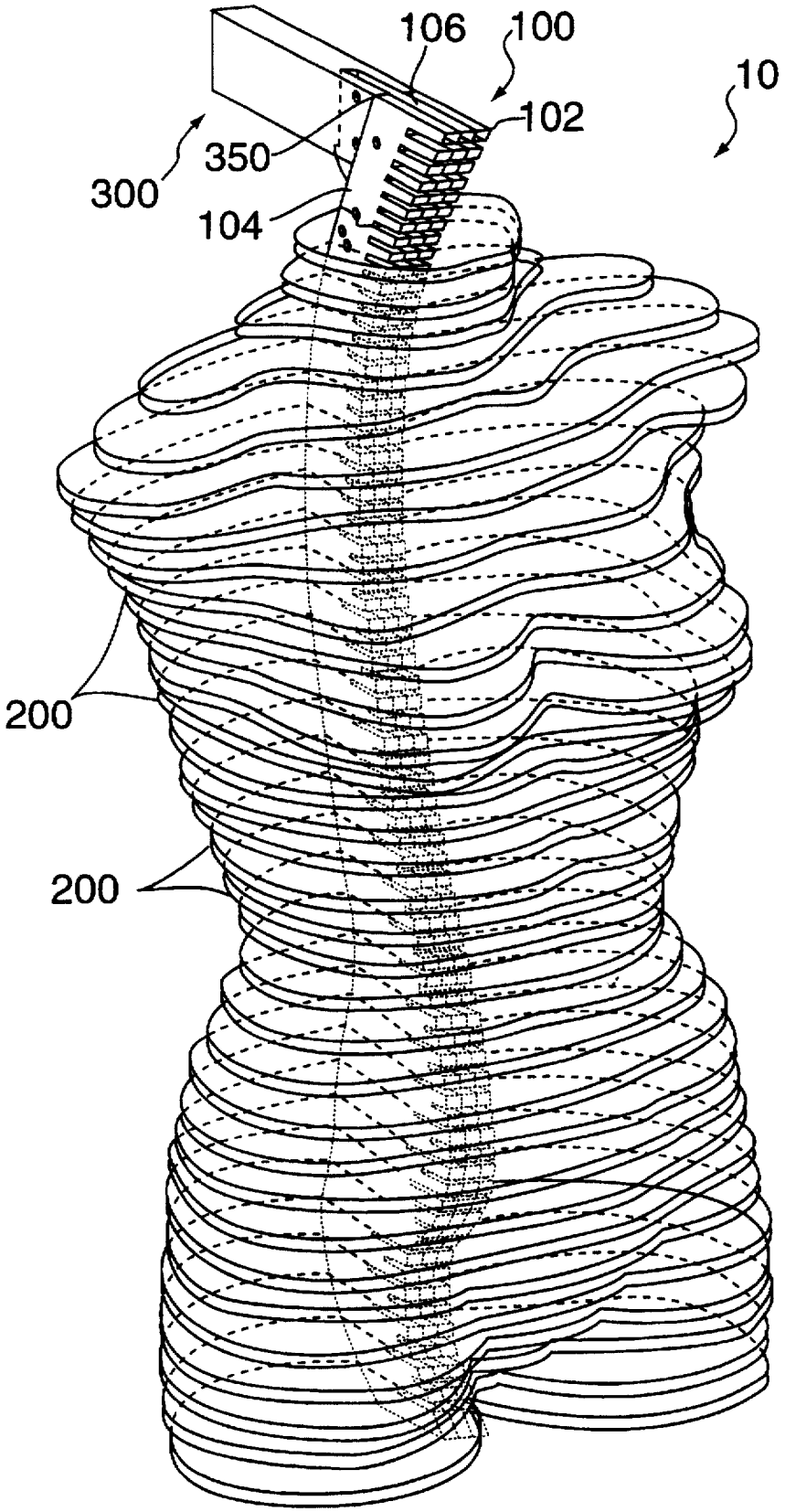
FIG. 1 is a perspective view of a clothing form in accordance with the invention.

In describing preferred embodiments of the present invention illustrated in the drawings, specific terminology is employed for the sake of clarity. However, the invention is not intended to be limited to the specific terminology so selected, and it is to be understood that each specific element includes all technical equivalents which operate in a similar manner to accomplish a similar purpose.

Referring now to FIG. 1, there is shown a laminar construction clothing form 10 in accordance with the present invention. The clothing form 10 comprises a spine 100 and a plurality of flat modular laminae or plates 200 which are parallel to and spaced apart from one another and removably interlock with the spine 100 at right angles thereto to give the appearance of a stylized human torso.

Figure 2:
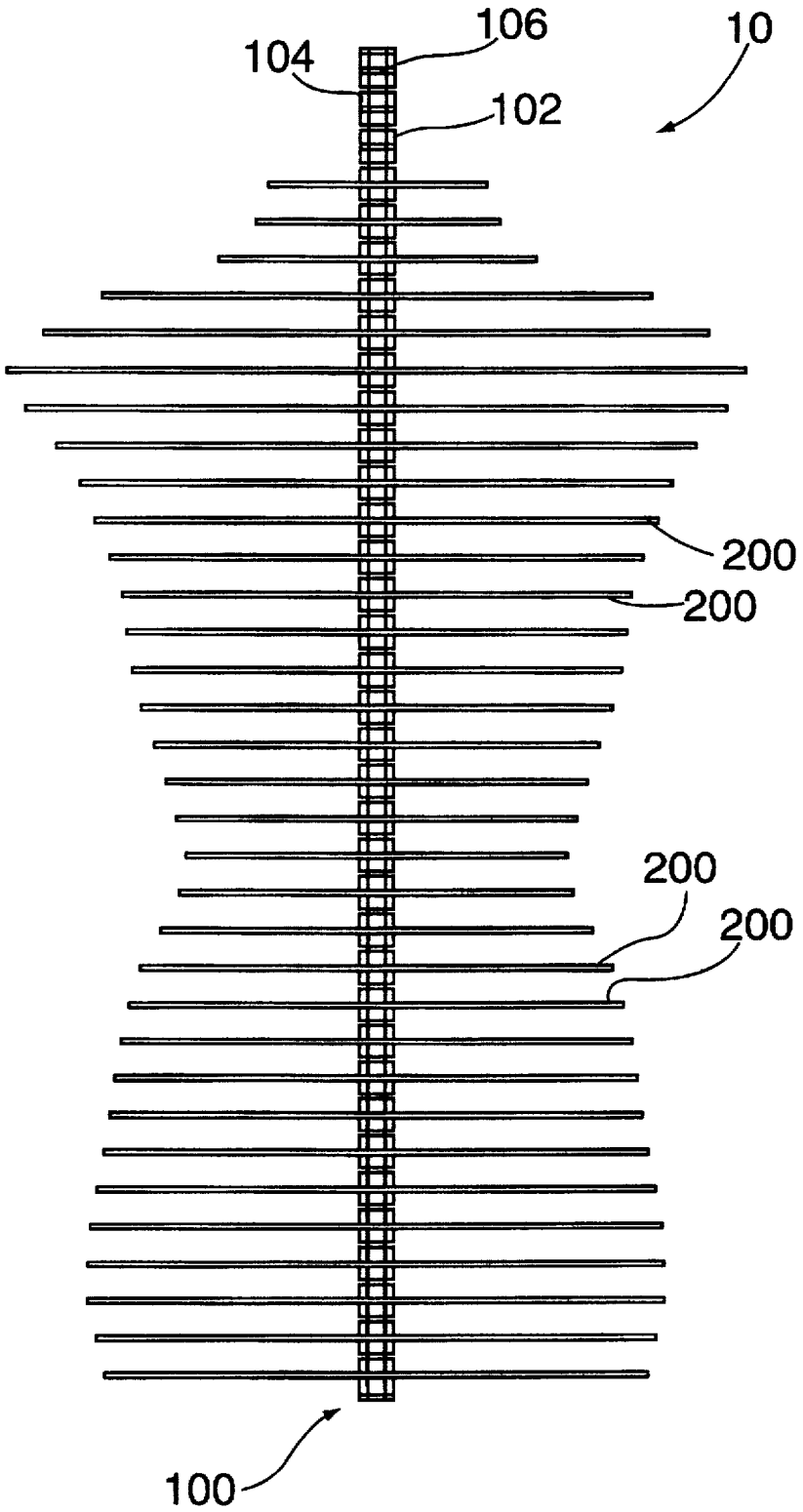
FIG. 2 is a front elevational view of the clothing form of FIG. 2.
Figure 3:
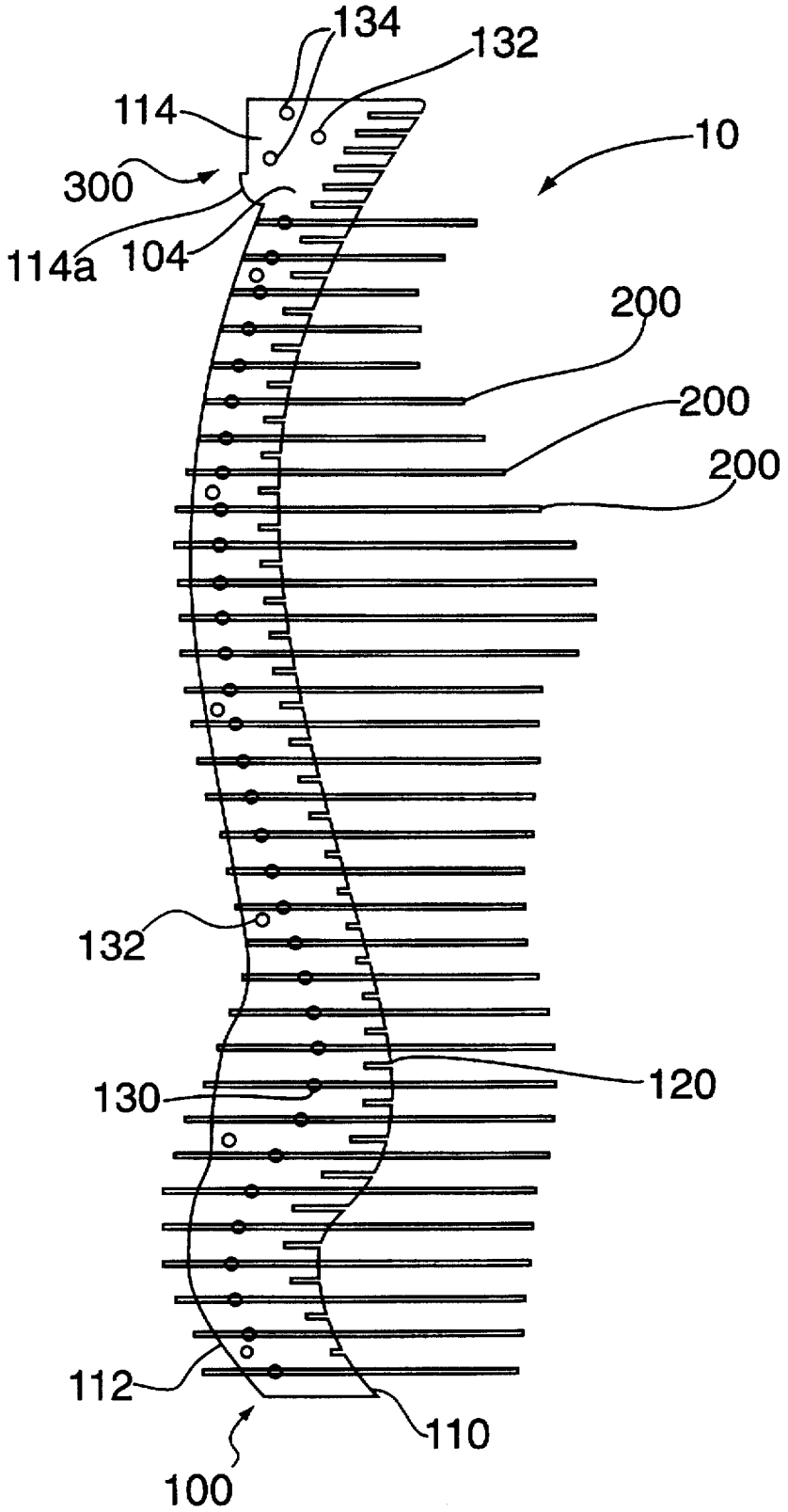
FIG. 3 is a right side elevational view of the clothing form of FIG. 2.
Figure 4:
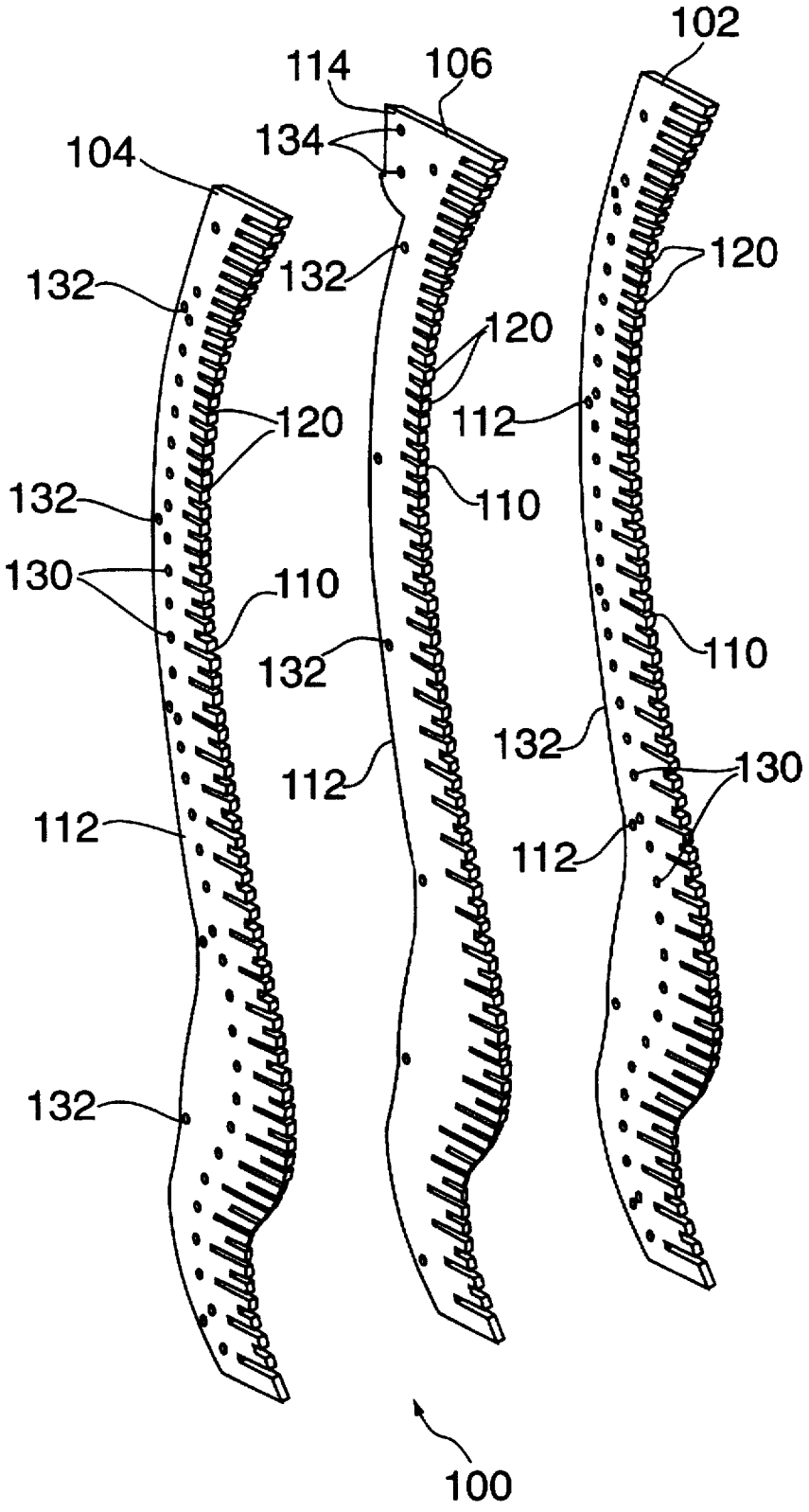
FIG. 4 is an exploded perspective view of a first embodiment of the spine of the clothing form of FIG. 1.
Figure 5:
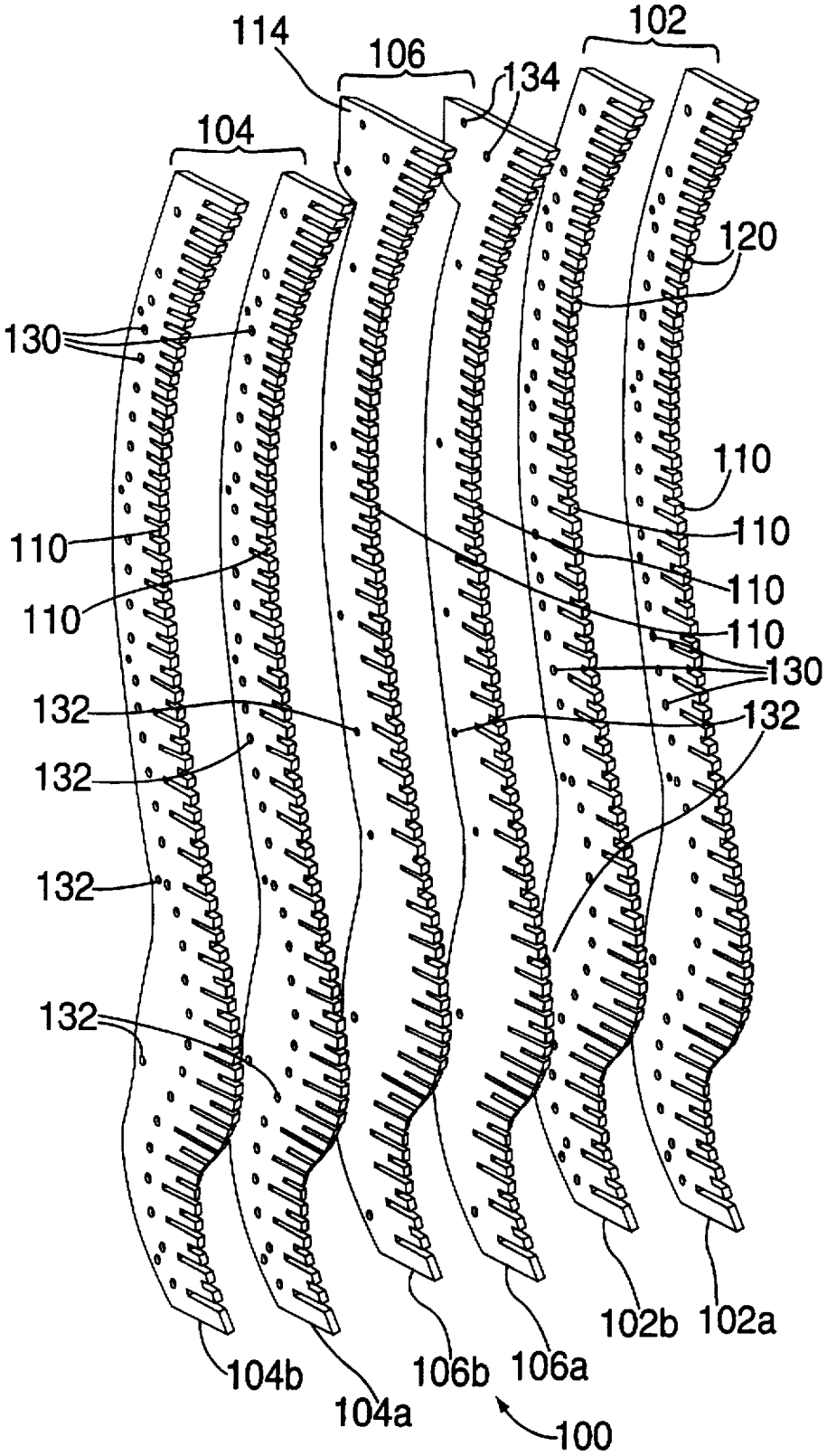
FIG. 5 is an exploded perspective view of a second embodiment of the spine of the clothing form of FIG. 1.

The spine 100 is itself of laminar construction, comprising left and right outer sections 102 and 104 and a central section 106. Each section can be formed as a single lamina, as shown in FIGS. 1, 2, and 4, or as two laminae 102*a* and 102*b*, 104*a* and 104*b*, and 106*a* and 106*b* having half the thickness of the single laminae 102, 104, and 106 shown in FIG. 4, as shown in FIG. 5. The number, and consequently the thickness, of the spine sections 102, 104, and 106 will depend in part on the material being used, and the ease and expense of cutting the material. As will be appreciated by those of skill in the art, it also would be possible to make the spine sections 102, 104, and 106 of more than two pieces.

In a preferred embodiment, the spine sections 102, 104, and 106 and the laminae 200 are all formed of aluminum plate, although rigid plastics and other rigid materials can also be used.

Figure 6:
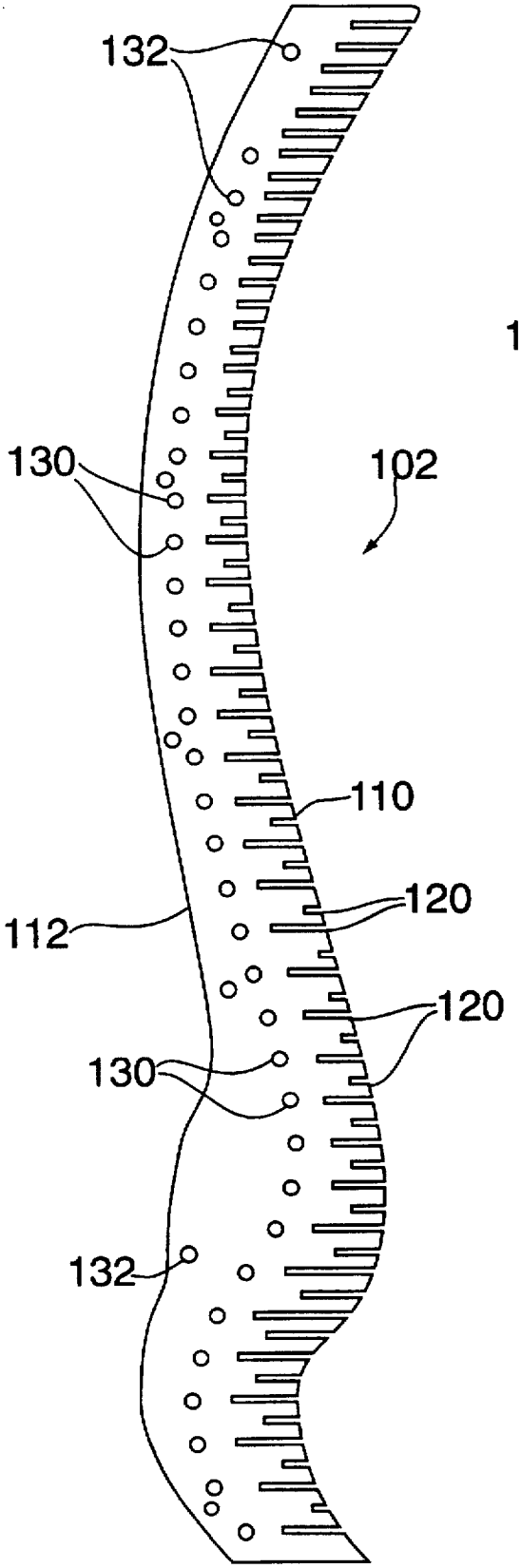
FIG. 6 is a side elevational view of the left outer section of the spine, the right outer section being identical thereto.
Figure 7:
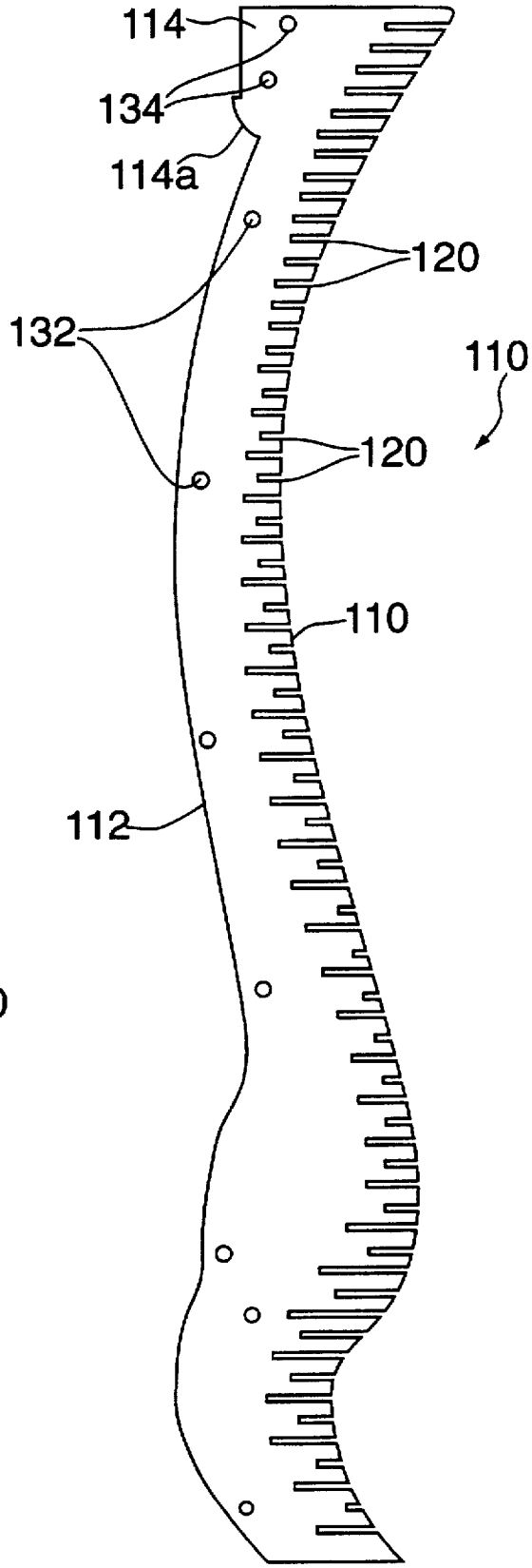
FIG. 7 is a side elevational view of the central section of the spine.

Referring now to FIGS. 4, 6, and 7, each of the spine sections 102, 104, and 106 has a forward-facing edge 110 and a rearward-facing edge 112. The outer spine sections 102 and 104 have identical profiles, and the central spine section 106 has a profile substantially identical to that of outer spine sections 102 and 104, all being generally similar to the side profile of a human spine, except that the central section 106 is provided at its upper end with a projection 114 at its rearward-facing edge 112, for a purpose to be described hereinafter. Also, the spine sections 102, 104, and 106 have formed therein a plurality of spaced parallel slots 120 extending inwardly from their forward-facing edges 110 in a direction perpendicular to their lengths. These slots 120 are identically located in each of the spine sections 102, 104, and 106 so as to be in registration when the spine sections 102, 104, and 106 are positioned side-by-side in the assembled clothing form 10.

Again referring to FIGS. 6 and 7, preferably, the slots 120 are of two different heights h1 and h2, the slots 120 of height h1 being alternated with the slots of height h2, except that there may be a plurality, e.g. six, of adjacent slots 120 of identical height h1 at the tops of the spine sections 102, 104, and 16. Height h1 is greater than height h2. For example, h1 can be 0.098 inch (0.249 cm), and h2 can be 0.125 inch (0.318 cm). Although the slots 120 are preferably of two different alternating heights h1 and h2, the transverse center lines of the slots 120 preferably are equidistantly spaced from each other. The depths of the slots 120, i.e., the distances between the open ends of the slots 120 at the forward facing edge 110 to the closed ends of the slots 120 vary depending upon their vertical locations on the spine sections 102, 104, and 106, for a purpose to be described hereinafter.

Slots 120 of height h2 in the left and right outer spine sections 102 and 104 have associated therewith cylindrical holes 130 extending through their respective outer spine sections 102 and 104 and having a first radius r1, for a purpose to be described hereinafter. The axes of holes 130 are a uniform distance from the closed ends of their associated slots 120, and are coplanar with the centerlines of their associated slots 120. In a preferred embodiment, radius r1 is 0.125 inch (0.318 cm).

All of the spine sections 102, 104, and 106 also have extending therethrough a plurality of cylindrical holes 132 spaced along the lengths of the spine sections 102, 104, and 106, inset from their rearward-facing edges 112. Holes 132 have a second radius r2 smaller than radius r1. In a preferred embodiment, radius r2 is 0.098 inch (0.249 cm). These holes 132 are identically located in each of the spine sections 102, 104, and 106 so as to be in registration when the spine sections 102, 104, and 106 are positioned side-byside in the assembled clothing form 10, in order to receive fasteners, as will be described in greater detail hereinafter.

Further, the projection 114 at the upper end of the central spine section 106 has at least two cylindrical holes 134 extending therethrough, for a purpose to be described hereinafter. The holes 134 can have the same radius r2 as the holes 132.

The laminae 200 are configured to resemble cross-sections of a human torso at different positions along the length of a human spine. A complete set of the laminae 200 for a clothing form 10 is shown in FIGS. 8A–8GG, each of the laminae 200 corresponding to a specific set of aligned slots 120 in the spine sections 102, 104, and 106. It will be appreciated by those of skill in the art that laminae of different dimensions and profiles can be provided corresponding to each slot 120 to provide both male and female torsos of different dimensions, thus enabling the clothing form 10 to be used with clothing of different sizes and styles.

Figure 9:
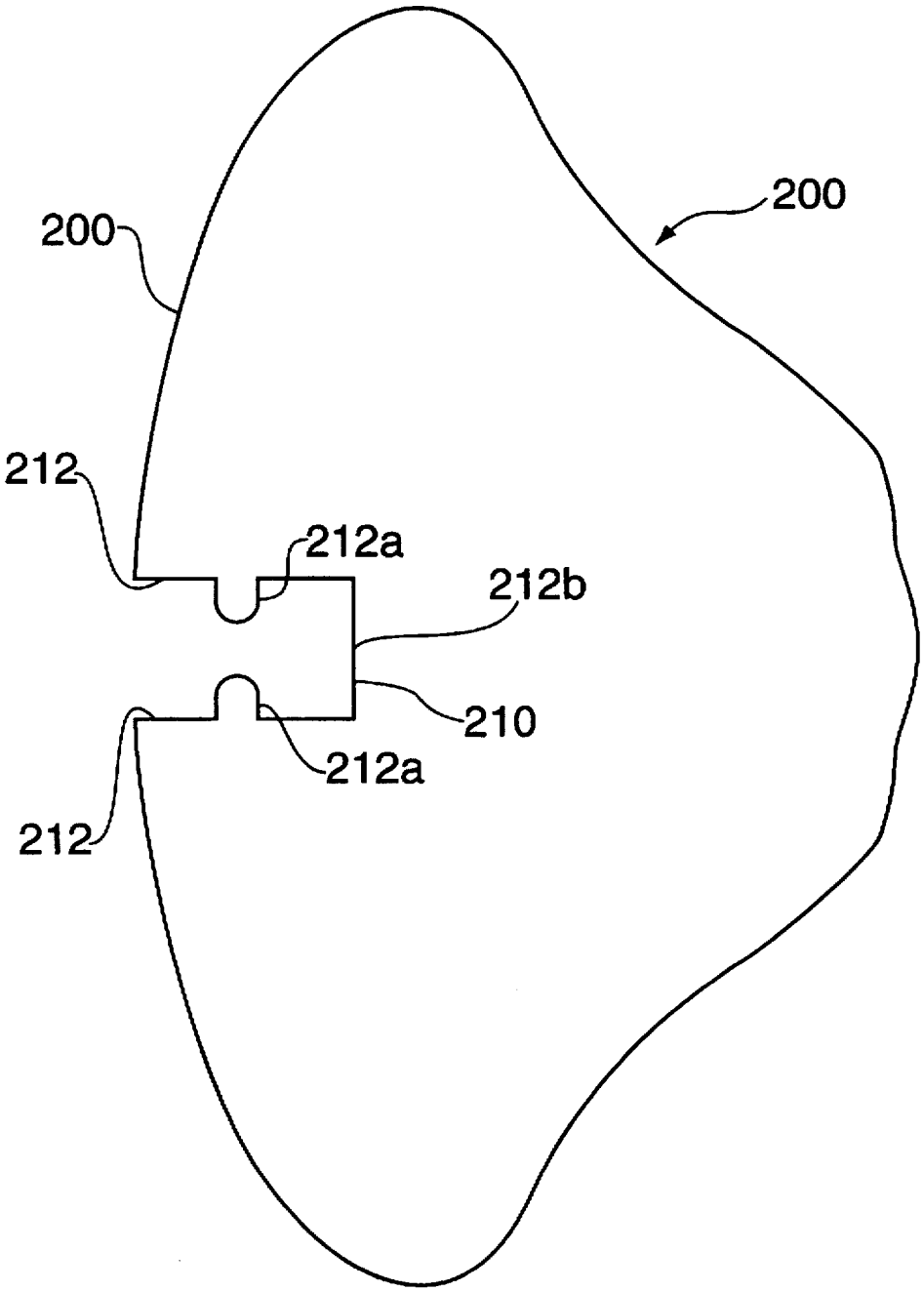
FIG. 9 is an enlarged view of the lamina of FIG. 8C.
Figure 11:
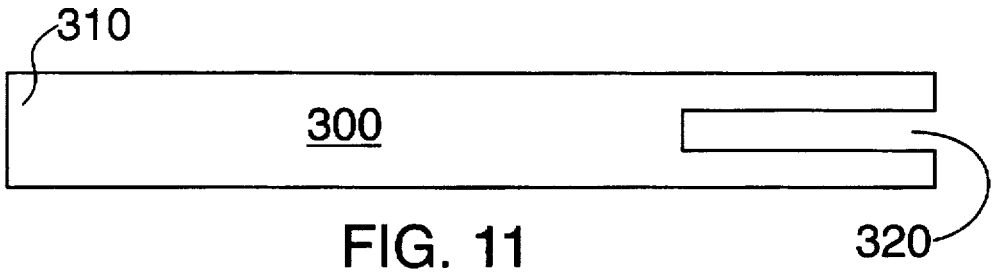
FIG. 11 is a top elevational view of the mounting bracket of FIG. 10.
Figure 10:
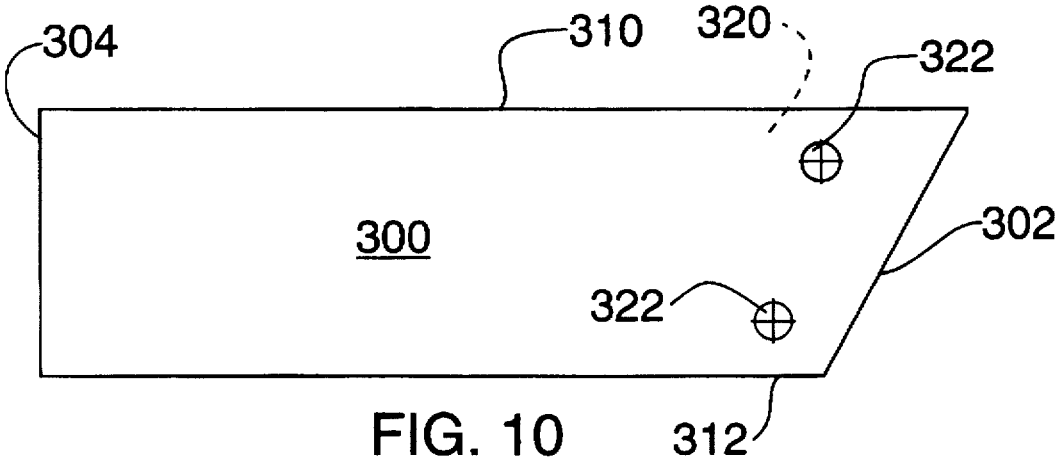
FIG. 10 is a side elevational view of the mounting bracket of the clothing form of FIG. 1.
Figure 12:
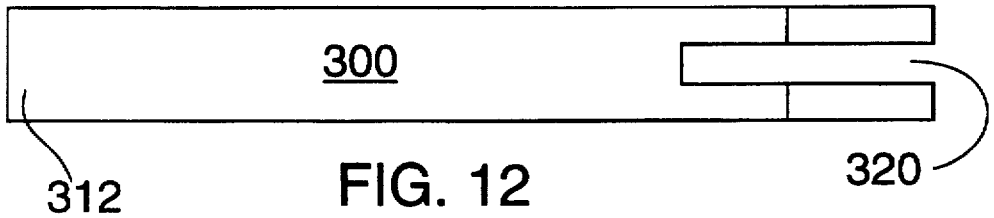
FIG. 12 is a bottom elevational view of the mounting bracket of FIG. 10.
Figure 13:
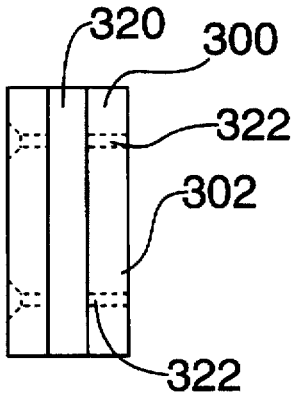
FIG. 13 is a front end elevational view of the mounting bracket of FIG. 10.
Figure 14:
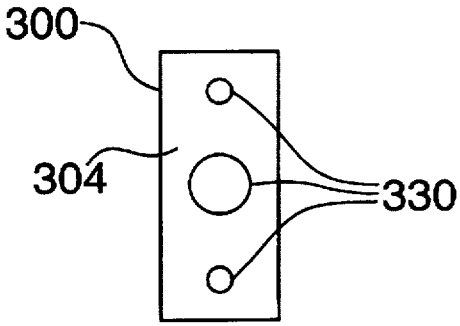
FIG. 14 is a back end elevational view of the mounting bracket of FIG. 10.

As can best be seen in FIG. 9, which is an enlarged view of the lamina shown in FIG. 8C, each lamina 200 has a rearward-facing edge 202 having a generally rectangular notch 210 formed therein. The opposed sides 212 of the notch 210 have opposed tabs 212*a* extending therefrom. The notches 210 are dimensioned to mate with the portion of the spine sections 102, 104, and 106 to the rear of their corresponding sets of aligned slots 120, so that the depths of the notches 210 vary depending upon the intended vertical locations of their laminae 200 on the spine 100, but the distance between the closed ends 212*b* of the notches 210 and the centerlines C of the tabs 212*a* is the same for all of the laminae 200.

In a preferred embodiment, the distance between opposed sides of the notches 210 is 0.755 inch (1.912 cm). The tabs 212*a* have rounded ends with a radius of 0.108 inch (0.274 cm), the distance between the tabs 212*a* being 0.414 inch (1.052 cm). The distance between the closed ends of the notches 210 and the centerlines of the tabs 212*a* is 0.582 inch (1.478 cm).

A mounting bracket 300 can be provided for mounting the clothing form 10 to a support surface such as a wall, or a support pole, or the like. The mounting bracket 300 can be made of the same material as the spine 100 and the laminae 200, and its width is the same as the width of the spine 100.

Referring now to FIGS. 11–14, the mounting bracket 300 has forward and rearward ends 302 and 304 and upper and lower sides 310 and 312. The side profile of the mounting bracket 300 is in the form of a trapezoid with the edges of the rearward end 304 and the upper and lower sides 310 and 312 being at right angles to each other, and the forward end 302 forming an acute angle with the upper side 310 and an obtuse angle with the lower side 312.

The projection 114 at the upper end of the central spine section 106 functions as a tenon for mating with a vertical mortise 320 of trapezoidal shape formed at the forward end 302 of the mounting bracket 300 and extending between the upper and lower sides 310 and 312. As will be appreciated by those of skill in the art, the mortise 320 is complementary in shape to the projection 114 and the upper ends of the rearward-facing edges 112 of the spine sections 102 and 104 are complementary in shape to the forward end 302 of the mounting bracket, so that the mounting bracket 300 as a whole will form an integrated structure with the spine 100. Also, the projection 114 has a projecting lip 114*a* at its bottom edge which is configured to extend below and rearwardly of the mortise 320 so as to engage the lower side 312 of the mounting bracket 300 and lock the projection 114 in place vertically in the mortise 320. Transverse bores 322 are formed through the mounting bracket 300 in communication with the mortise 320, and are located so as to register with the holes 134 in the projection 114 when the projection 114 is inserted into the mortise 320, for a purpose to be described hereinafter.

A plurality of tapped holes 330 are also formed in the mounting bracket 300 extending inwardly from the rearward end 304. The holes 330 are arranged one under the other with their centers in vertical alignment, also for a purpose to be described hereinafter.

Figure 15:
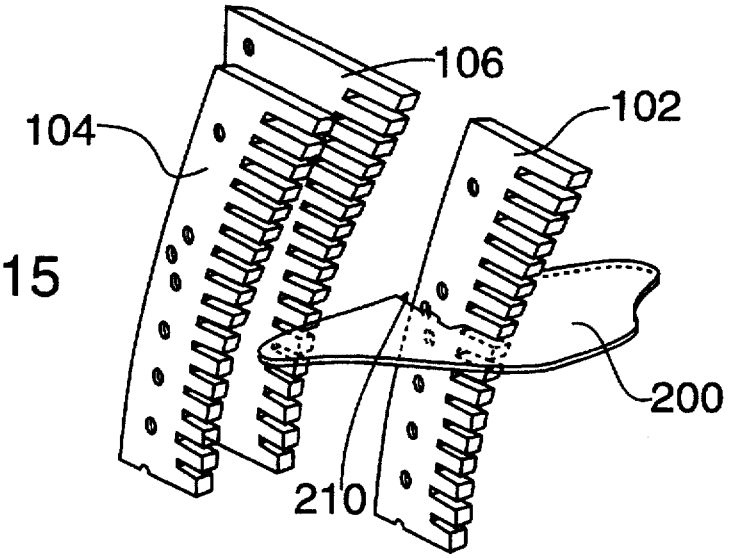
FIG. 15 is an exploded perspective view of the assembly of one lamina to the left outer spine section.

The assembly of the form 10 is described with reference to FIGS. 15–17, in which only one lamina 200 is shown for the sake of clarity. First, the laminae 200 are assembled, preferably in order from top to bottom or bottom to top, to one of the outer spine sections 102 or 104. FIG. 15 shows the assembly of the top lamina 200 to the left spine section 102, the remaining laminae 200 being assembled to the left spine section 102 in the same manner. The notch 210 of each lamina is centered relative to the spine section 102 or 104, and then shifted to the right (for the left spine section 102) as shown in FIG. 15, or the left (for the right spine section 104) to engage the left or right tab 212*a* with the hole 130 in its corresponding left or right spine section 102 or 104. It should be understood that at this point, the laminae 200 are being held in place by engagement of one of their tabs 212*a* with a corresponding hole 130 and by engagement of their upper and lower surfaces inwardly of their notches 210 with the slots 120 of the spine section 102 or 104.

Figure 16:
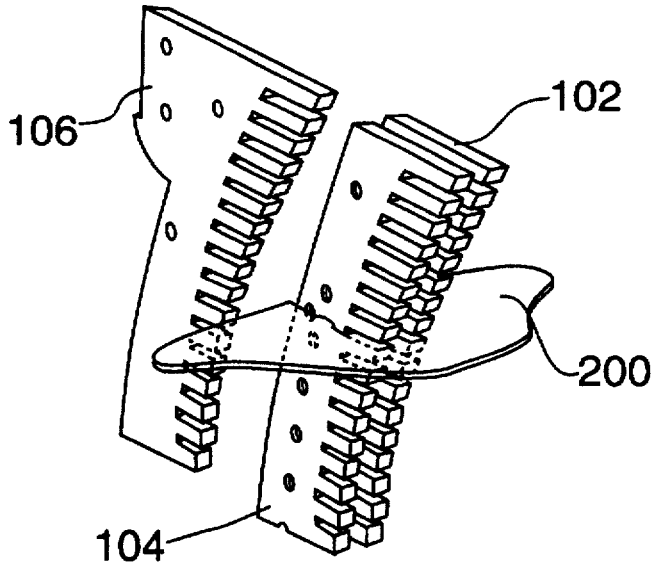
FIG. 16 is an exploded perspective view of the assembly of the right outer spine section to the assembled lamina and left outer spine section shown in FIG. 15.

After all of the laminae 200 have been assembled to the first of the left or right spine sections 102 or 104, the other of the left or right spine sections 102 or 104 is assembled to the laminae 200 by centering it in the aligned notches 210, and then shifting it to the right (for the left spine section 102) or the left (for the right spine section 104), as shown in FIG. 16, to engage the holes 130 with the left or right tabs 212*a* of the laminae 200.

Figure 17:
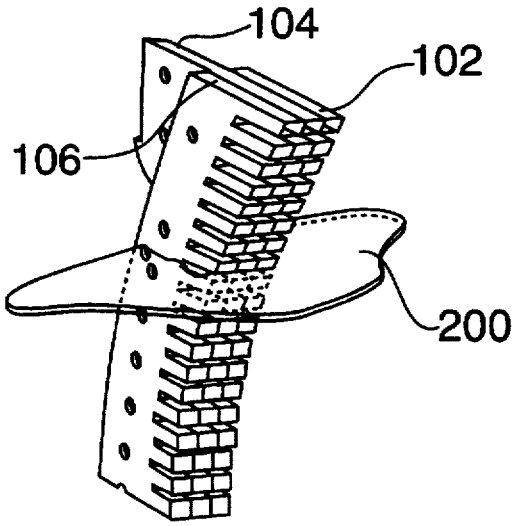
FIG. 17 is a perspective view of the assembly of the central spine section to the assembled lamina and left and right spine sections shown in FIG. 16.

Last, the central spine section 106 is centered between the left and right spine sections 102 and 104 and slid into place in alignment between them, as shown in FIG. 17. The placement of the central spine section 106 between the left and right spine sections 102 and 104 locks the left and right spine sections 102 and 104 into place with the tabs 212*a*, which prevents the laminae 200 from being removed from the spine 100. Fasteners 350 can be inserted through the aligned holes 132 in the spine sections 102, 104, and 106 to prevent the central spine section 106 from being displaced or removed.

The same procedure can be used for assembling the laminae 200 to the spine 100 in the case where the spine sections 102, 104, and 106 are formed of multiple pieces. For example, if the laminae 200 are to be assembled to the left spine section 102, the pieces 102*a* and 102*b* are temporarily held together as the laminae 200 are placed; next the pieces 104*a* and 104*b* are temporarily held together and slid in place relative to the laminae 200; and finally the pieces 106*a* and 106*b* are together slid into place between the assembled left and right spine sections 102 and 104.

Because the spine 100 and the laminae 200 interlock at their edges, it is possible to exchange one or more of the laminae 200 without having to remove all of the laminae 200 above or below them. In order to exchange a lamina 200, it is only necessary to remove the central spine section 106 and one of the outer spine sections 102 and 104. With two of the spine sections removed, any of the laminae 200 can be removed at will and replaced with other laminae. The spine sections can then be reassembled to the laminae 200.

If desired, the mounting bracket 300 can be mated to the projection 114, and additional fasteners 350 inserted through the aligned holes 322 and 134 in the mounting bracket 300 and the projection 114, respectively, such as threaded bolts, with or without separate threaded nuts. The mounting bracket 300 can in turn be connected to a wall or other supporting surface, support pole, or the like using fasteners, pegs, or the like inserted into the tapped holes 330.

Figure 18:
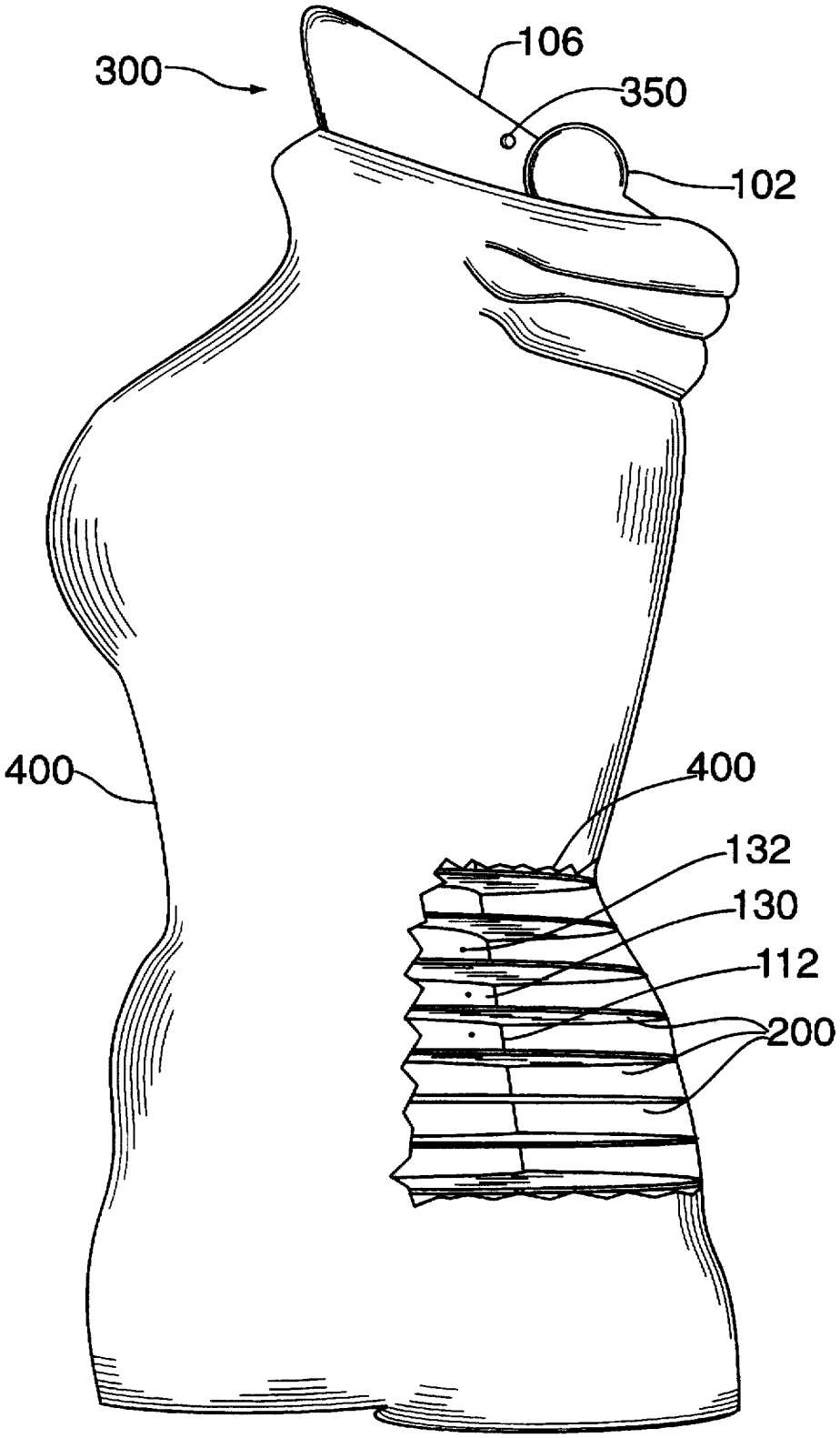
FIG. 18 is a perspective view of the clothing form of FIG. 1 with an elastic material "skin" stretched over the laminae.

Modifications and variations of the above-described embodiments of the present invention are possible, as appreciated by those skilled in the art in light of the above teachings. For example, as shown in FIG. 18, a superficial "skin" 400 formed of a tube of an elastic material can be stretched over the laminae 200 to give the clothing form 10 a less stylized, more realistic appearance.

It is therefore to be understood that, within the scope of the appended claims and their equivalents, the invention may be practiced otherwise than as specifically described.

What is claimed is:

1. A clothing form comprising:

a spine having a laminar form, said spine in profile being generally similar to the side profile of a human spine; and a plurality of flat modular laminae parallel to and spaced apart from one another along said spine at right angles thereto to give the appearance of a stylized human torso, said laminae being configured to resemble cross-sections of a human torso at different positions along the length of a human spine, each of said laminae having a specific position on said spine, and each of said laminae having a rearwardfacing edge removably interlocking with said spine.

2. The clothing form of claim 1, further comprising a superficial skin formed of a tube of an elastic material stretched over said laminae.

3. A clothing form comprising:

a laminar construction spine including left and right outer spine sections and a central spine section, said spine sections being of laminar form and having opposed forward and rearward-facing edges, and spine sections having formed therein a plurality of spaced parallel slots extending inwardly from said forward-facing edges, said slots being identically located in each of said spine sections so as to be in registration when said spine sections are positioned side-by-side so as to define a plurality of sets of aligned slots; and a plurality of parallel, flat modular laminae at right angles to said spine and which removably interlock with said spine to give the appearance of a stylized human torso, said laminae being configured to resemble cross-sections of a human torso at different positions along the length of a human spine, each of said laminae corresponding to a specific one of said sets of slots in said spine sections, and each of said lamina having a rearward-facing edge dimensioned for insertion into said corresponding specific sets of slots.

4. The clothing form of claim 3, wherein said spine sections in profile are generally similar to the side profile of a human spine.

5. The clothing form of claim 3, wherein said laminae are spaced apart from one another.

6. The clothing form of claim 3, further comprising a superficial skin formed of a tube of an elastic material stretched over said laminae.

7. The clothing form of claim 3, wherein each of said rearward-facing edges has a generally rectangular notch formed therein, said notches being dimensioned to mate with the portion of said spine sections to the rear of their corresponding sets of slots.

8. The clothing form of claim 7, wherein said left and right outer spine sections have aligned holes extending therethrough rearwardly of said slots, and wherein said notches have opposed sides having opposed tabs extending therefrom positioned and dimensioned to interlock with said holes.

9. The clothing form of claim 3, wherein said left, right, and central spine sections have extending therethrough a plurality of holes spaced along the lengths of said spine sections, inset from said rearward-facing edges, said holes being identically located in each of said spine sections so as to be in registration when said spine sections are positioned side-by-side; and wherein said clothing form further comprises a plurality of fasteners inserted through said holes.

10. The clothing form of claim 7, wherein:

said left and right outer spine sections have aligned first holes extending therethrough rearwardly of said slots, and wherein said notches have opposed sides having opposed tabs extending therefrom positioned and dimensioned to interlock with said first holes;

said left, right, and central spine sections have extending therethrough a plurality of second holes spaced along the lengths of said spine sections, inset from said rearward-facing edges, said second holes being identically located in each of said spine sections so as to be in registration when said spine sections are positioned side-by-side; and said clothing form further comprises a plurality of fasteners inserted through said second holes.

11. The clothing form of claim 3, further comprising a mounting bracket fastened to said spine for mounting said clothing form to a support.

12. The clothing form of claim 11, wherein said mounting bracket has a forward end having a vertical mortise formed therein, and said central spine section is provided at the upper end at said rearward-facing edge with a projection which functions as a tenon for mating with said mortise, said mortise being complementary in shape to said projection.

13. The clothing form of claim 12, wherein:

said mounting bracket also has a rearward end and upper and lower sides, and said mounting bracket has a side profile in the form of a trapezoid with the edges of said rearward end and said upper and lower sides being at right angles to each other, and the edges of said forward end forming an acute angle with said upper side and an obtuse angle with said lower side; and said mortise is complementary in shape to said projection and the upper ends of said rearward-facing edges of said spine sections are complementary in shape to said forward end of said mounting bracket, so that said projection locks in place vertically in said mortise and said mounting bracket as a whole forms an integrated structure with said spine.

14. A clothing form comprising:

a laminar construction spine including left and right outer spine sections and a central spine section, said spine sections being of laminar form and having opposed forward and rearward-facing edges, and spine sections having formed therein a plurality of spaced parallel alternating first and second slots extending inwardly from said forward-facing edges, said first and second slots being identically located in each of said spine sections so as to be in registration when said spine sections are positioned side-by-side, so as to define a plurality of sets of aligned first and second slots; and a plurality of parallel, flat modular laminae at right angles to said spine and which removably interlock with said spine to give the appearance of a stylized human torso, said laminae being configured to resemble cross-sections of a human torso at different positions along the length of a human spine, each of said laminae corresponding to a specific one of said sets of second slots in said spine sections, and each of said lamina having a rearward-facing edge dimensioned for insertion into said corresponding specific sets of second slots.

15. The clothing form of claim 14, wherein said spine sections in profile are generally similar to the side profile of a human spine.

16. The clothing form of claim 14, wherein said laminae are spaced apart from one another.

17. The clothing form of claim 14, further comprising a superficial skin formed of a tube of an elastic material stretched over said laminae.

18. The clothing form of claim 14, wherein each of said rearward-facing edges has a generally rectangular notch formed therein, said notches being dimensioned to mate with the portion of said spine sections to the rear of their corresponding sets of second slots.

19. The clothing form of claim 18, wherein said left and right outer spine sections have aligned holes extending therethrough rearwardly of said second slots, and wherein said notches have opposed sides having opposed tabs extending therefrom positioned and dimensioned to interlock with said holes.

20. The clothing form of claim 18, wherein:

said left and right outer spine sections have aligned first holes extending therethrough rearwardly of said second slots, and wherein said notches have opposed sides having opposed tabs extending therefrom positioned and dimensioned to interlock with said first holes;

said left, right, and central spine sections have extending therethrough a plurality of second holes spaced along the lengths of said spine sections, inset from said rearward-facing edges, said second holes being identically located in each of said spine sections so as to be in registration when said spine sections are positioned side-by-side; and said clothing form further comprises a plurality of fasteners inserted through said second holes.

21. The clothing form of claim 14, further comprising a mounting bracket fastened to said spine for mounting said clothing form to a support.

22. The clothing form of claim 21, wherein said mounting bracket has a forward end having a vertical mortise formed therein, and said central spine section is provided at the upper end at said rearward-facing edge with a projection which functions as a tenon for mating with said mortise, said mortise being complementary in shape to said projection.

23. The clothing form of claim 22, wherein:

said mounting bracket also has a rearward end and upper and lower sides, and said mounting bracket has a side profile in the form of a trapezoid with the edges of said rearward end and said upper and lower sides being at right angles to each other, and the edges of said forward end forming an acute angle with said upper side and an obtuse angle with said lower side; and said mortise is complementary in shape to said projection and the upper ends of said rearward-facing edges of said spine sections are complementary in shape to said forward end of said mounting bracket, so that said projection locks in place vertically in said mortise and said mounting bracket as a whole forms an integrated structure with said spine.

* * * * *